US009109552B2

(12) United States Patent
Williams

(10) Patent No.: US 9,109,552 B2
(45) Date of Patent: Aug. 18, 2015

(54) CANISTER PURGE VALVE WITH INTEGRATED VACUUM GENERATOR AND CHECK VALVES

(75) Inventor: Benjamin Dominick Manton Williams, Chatham (CA)

(73) Assignee: Continental Automotive Systems, Inc., Auburn Hills, MI (US)

( * ) Notice: Subject to any disclaimer, the term of this patent is extended or adjusted under 35 U.S.C. 154(b) by 568 days.

(21) Appl. No.: 13/524,275

(22) Filed: Jun. 15, 2012

(65) Prior Publication Data

US 2012/0318244 A1 Dec. 20, 2012

Related U.S. Application Data

(60) Provisional application No. 61/497,837, filed on Jun. 16, 2011.

(51) Int. Cl.
*F02M 33/02* (2006.01)
*F02M 25/08* (2006.01)
*F02D 41/00* (2006.01)

(52) U.S. Cl.
CPC ..... *F02M 25/089* (2013.01); *F02D 41/0032* (2013.01); *F02M 25/08* (2013.01)

(58) Field of Classification Search
CPC ..... F02M 25/089; F02M 25/0836; F02M 25/0809; F02M 25/08
USPC ..... 123/516, 517, 518, 519, 520, 521
See application file for complete search history.

(56) References Cited

U.S. PATENT DOCUMENTS 5,005,550 A * 4/1991 Bugin et al. ..... 123/520
7,373,930 B1 * 5/2008 Hadre ..... 123/520
2007/0023016 A1 2/2007 Mills
2012/0318244 A1 12/2012 Williams
2013/0019844 A1 * 1/2013 Kulkarni et al. ..... 123/520
2013/0152904 A1 * 6/2013 Balsdon et al. ..... 123/518
2014/0311602 A1 * 10/2014 Jefford et al. ..... 137/899
2014/0326337 A1 * 11/2014 Jefford et al. ..... 137/487.5

FOREIGN PATENT DOCUMENTS

DE 102009024697 A1 12/2010
JP 63162965 U 10/1998
WO 2012174347 A1 12/2012
WO 2013023920 A1 2/2013

OTHER PUBLICATIONS

International Search Report and the Written Opinion of the International Searching Authority, PCT/US2012/042632, Apr. 24, 2013.

* cited by examiner

*Primary Examiner* — Mahmoud Gimie
*Assistant Examiner* — Sizo Vilakazi

(57) ABSTRACT

An integrated canister purge valve for a turbocharged vehicle engine includes a valve member having a housing and being constructed and arranged to control vapor purge flow from a fuel tank and canister structure to an air intake manifold. A body is coupled to the housing. The body defines an interior space. Structure separating the interior space into a first chamber and a second chamber isolated from the first chamber. The first chamber has an inlet port and an outlet port. A vacuum generator is provided in the first chamber and in fluid communication with the inlet and outlet ports. A first check valve is in the first chamber between the vacuum generator and the valve member and a second check valve is in the second chamber between the valve member and a manifold outlet port.

10 Claims, 2 Drawing Sheets

CANISTER PURGE VALVE WITH INTEGRATED VACUUM GENERATOR AND CHECK VALVES

CROSS-REFERENCE TO RELATED APPLICATIONS

This application claims priority to Provisional Patent Application No. 61/497,837, filed Jun. 16, 2011. The disclosure of the above application is incorporated herein by reference.

FIELD OF THE INVENTION

This invention relates to a vehicle canister purge system for turbocharged engines and, more particularly, to a canister purge valve with integrated vacuum generator and check valves.

BACKGROUND OF THE INVENTION

With normally aspirated engines, fuel vapors are purged from a canister by utilizing the intake manifold's vacuum pressure to draw air through the canister. With turbocharged engines, there is often a positive manifold pressure generated during boost and thus there is no vacuum to draw air through the canister. Therefore, it is necessary to provide means to produce an air moving pressure differential with atmosphere so that air can be drawn from the canister to the intake manifold and be directed to the combustion chamber, thereby purging the fuel vapors by burning.

A venturi tube or nozzle is used to generate a vacuum on a turbocharged vehicle engine by scavenging from the pressure differential across the turbo (14 psi or more) to drive air through the a venturi nozzle from the turbocharger outlet and back into the turbocharger inlet. The high velocity airflow and sonic shock waves in the venturi nozzle generate a pressure lower than atmospheric (vacuum) which is used to draw purge air flow into the scavenged turbo loop.

Typically this conventional venturi and scavenging loop is an isolated loop of plumbing, requiring a tube from the vacuum port on the venturi nozzle to a port on the purge valve. The purge valve is protected from purge loss during naturally aspirated conditions and from turbo pressures by a check valve located between the venturi nozzle and the purge valve, and another check valve located between the intake manifold and the purge valve respectively. Thus, such an arrangement requires multiple plumbing connections and discrete components that increase cost.

There is a need to provide a compact canister purge valve for a turbocharged engine, with canister purge valve having an integrated vacuum generator and check valves.

SUMMARY OF THE INVENTION

An object of the invention is to fulfill the need referred to above. In accordance with the principles of the present invention, this objective is achieved by providing an integrated canister purge valve for a turbocharged vehicle engine. The valve includes a valve member having a housing and is constructed and arranged to control vapor purge flow from a fuel tank and canister structure to an air intake manifold. A body is coupled to the housing. The body defines an interior space. Structure separates the interior space into a first chamber and a second chamber. The first chamber has an inlet port and an outlet port. A vacuum generator is provided in the first chamber and is in fluid communication with the inlet and outlet ports. The vacuum generator is constructed and arranged to receive air from a turbocharger outlet, via the inlet port, to create a first vacuum when the air passes through the vacuum generator, and to direct air to an inlet of the turbocharger, via the outlet port, to define a scavenging air flow loop. A first check valve is provided in the first chamber between the vacuum generator and the valve member, and a second check valve is provided in the second chamber between the valve member and an manifold outlet port. The manifold outlet port is constructed and arranged to be coupled to an intake manifold. The first and second check valves are constructed and arranged such that 1) when the turbocharger is operating and the intake manifold is under positive pressure, the second check valve closes, while the first check valve opens upon the vacuum generator generating the first vacuum, to permit the purge flow to be drawn into the scavenging air flow loop and 2) in a naturally aspirated condition, manifold vacuum closes the first check valve and opens the second check valve to divert all of the purge flow through the manifold outlet port and to the intake manifold.

In accordance with yet another aspect of the invention, a method of controlling vapor purge flow in turbocharged vehicle provides a canister purge valve having a valve member constructed and arranged to control vapor purge flow from a fuel tank and canister structure to an air intake manifold. The purge valve has an integral vacuum generator and first and second check valves that are integral with the canister purge valve. The first check valve is disposed between the vacuum generator and the valve member and the second check valve is disposed between the valve member and a manifold outlet port, the manifold outlet port being coupled to the intake manifold. The method defines a scavenging air flow loop from a turbocharger outlet through the vacuum generator and to an inlet of the turbocharger, with the vacuum generator generating a first vacuum due to the air flow there-trough, When the turbocharger is operating and the intake manifold is under positive pressure, the method ensures that the second check valve closes, while the first check valve opens upon the vacuum generator generating the first vacuum, to permit vapor purge flow to be drawn through the valve member into the scavenging air flow loop. During a naturally aspirated condition, the method ensures that vacuum created by the intake manifold closes the first check valve and opens the second check valve to divert all of the purge flow through the manifold outlet port and to the intake manifold.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings wherein like numbers indicate like parts, in which.

DETAILED DESCRIPTION OF THE EXEMPLARY EMBODIMENTS

Figure 1:
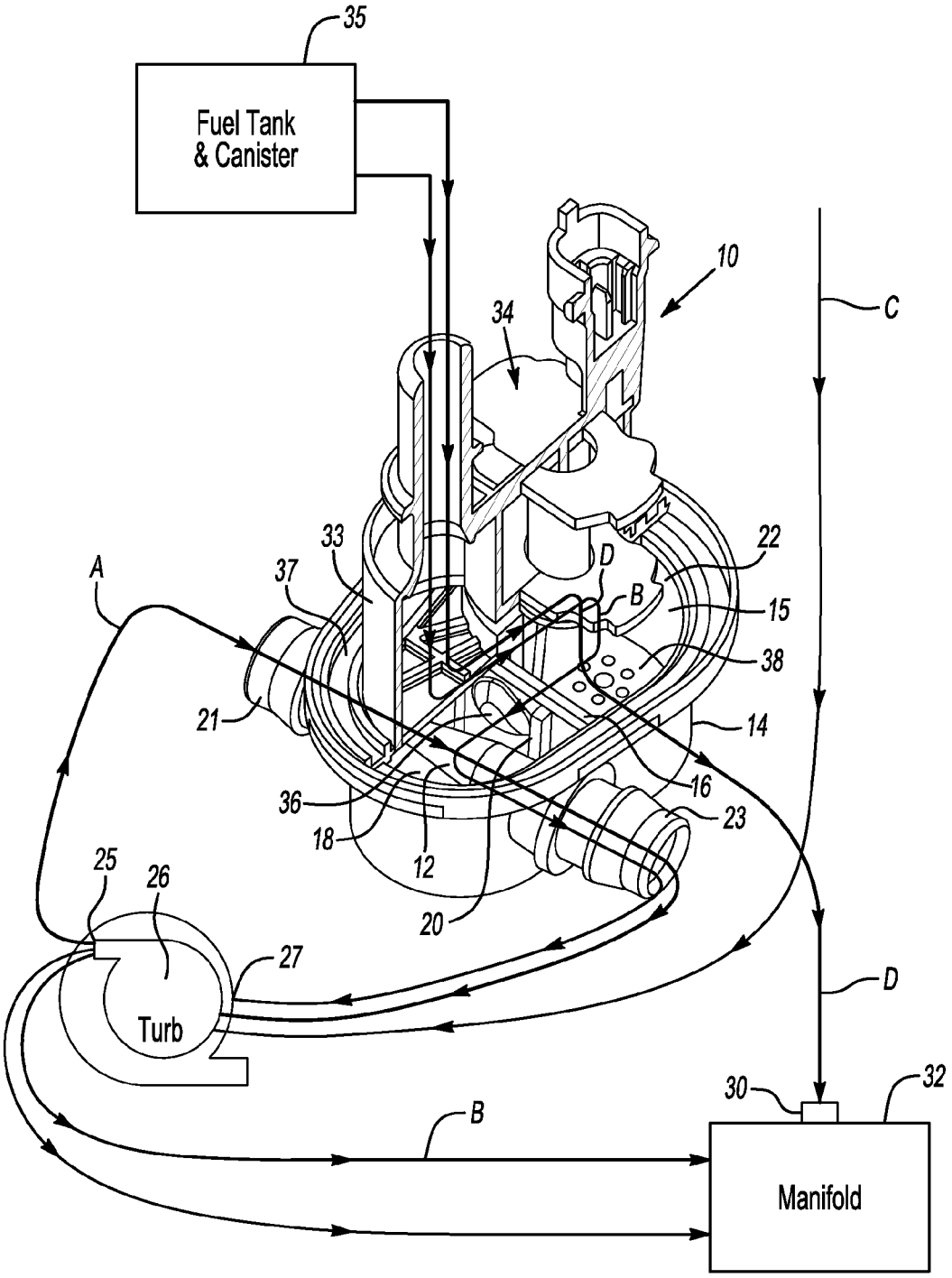
FIG. 1 is a view of an integrated canister purge valve, shown partially in section, in a canister purge system of a turbocharged vehicle engine, in accordance with an embodiment.

With reference to FIG. 1, an integrated canister purge valve for a turbocharged vehicle engine is shown, generally indicated at 10, in accordance with an embodiment. The integrated canister purge valve 10 incorporates both a vacuum generator 12 and two check valves 36, 38 in one small package, reducing the number of plumbing connections in the system from a possible twelve to just four connections. The integration is accomplished by including a venturi tube 12 (as the vacuum generator) in the lower body 14 of the canister purge valve 10. The lower body 14 defines an interior space 15. Structure, such as a wall 16 and welded middle cap member 18 separate the interior space 15 of the lower body 14 into two chambers 20, 22. The first chamber 20 has an inlet port 21 and an outlet port 23.

The vacuum generator or venturi tube 12 is in the first chamber 20 and is in fluid communication with the inlet port 21 and outlet port 23. The vacuum generator is constructed and arranged to receive air from the outlet 25 of the turbocharger 26, via the inlet port 21, to create a first vacuum when the air passes through the venturi tube 12, and to direct air to an inlet 27 of the turbocharger 26, via the outlet port 23, to define a scavenging flow loop A, so that venturi driven purge flow B can be drawn into the scavenging flow loop A, as explained more fully below. Main intake airflow is shown by arrow C.

Figure 2:
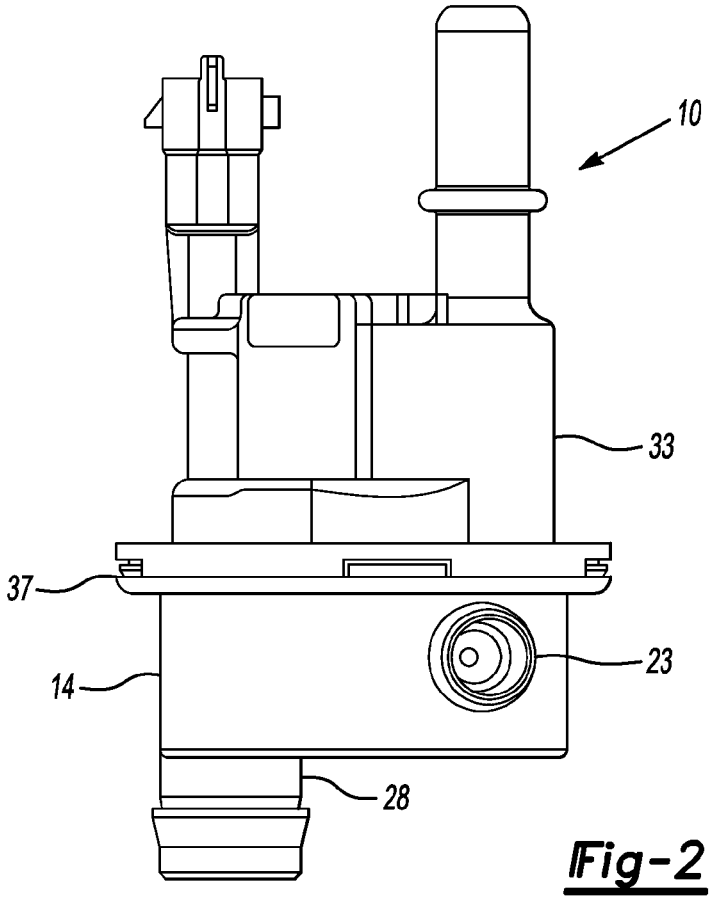
FIG. 2 is a side view of the canister purge valve of FIG. 1.

Chamber 22 has a manifold outlet port 28 (see FIG. 2) that communicates with an inlet port 30 of an intake manifold 32 associated with an engine (not shown). Thus, chamber 20 is associated with vacuum generated by the venturi tube 12 and chamber 22 is associated with vacuum generated by the intake manifold 32. These two vacuum conditions are mutually exclusive, and isolated by means of the first and second check valves 36, 38, respectively, that are integral with the valve 10 and are disposed in the lower body 14. In particular, first check valve 36 is provided between valve member 34 of the canister purge valve 10 and the venturi tube 12, and second check valve 38 is provided between the valve member 34 and the intake manifold 32. The valve member 34 is disposed between the fuel tank and canister structure 35 and the intake manifold 32. The valve member 34 may be of any conventional configuration, such as the solenoid type disclosed in U.S. Patent Publication 20080000456 A1, the content of which is hereby incorporated by reference into this specification. As best shown in FIG. 2, the lower body 14 and a housing 33 of the valve member 34 are preferably joined in a removable manner by a snap-fit and arrangement 37, with an O-ring there-between. Alternatively, the lower body 14 and housing 33 can be joined by a weld connection, which eliminates the O-ring.

If the turbocharger 26 is functioning, the manifold 32 is under positive pressure and the check valve 38, associated with the manifold port 30, closes. The vacuum generated by the scavenging flow loop A pulls the check valve 36 open, permitting flow through the scavenging flow loop A that draws in vapor purge flow B that passes the valve member 34. The purge flow is then directed to the manifold 32 and thus to the engine to be consumed.

In the naturally aspirated condition (flow indicated by arrow D), the vacuum created at the manifold 32 pulls the check valve 38 open, thus permitting flow to pass from the valve member 34 to the manifold 32. In addition, the manifold vacuum pulls the check valve 36 shut, diverting all purge flow directly to the manifold 32 to be consumed in the engine.

Figure 3:
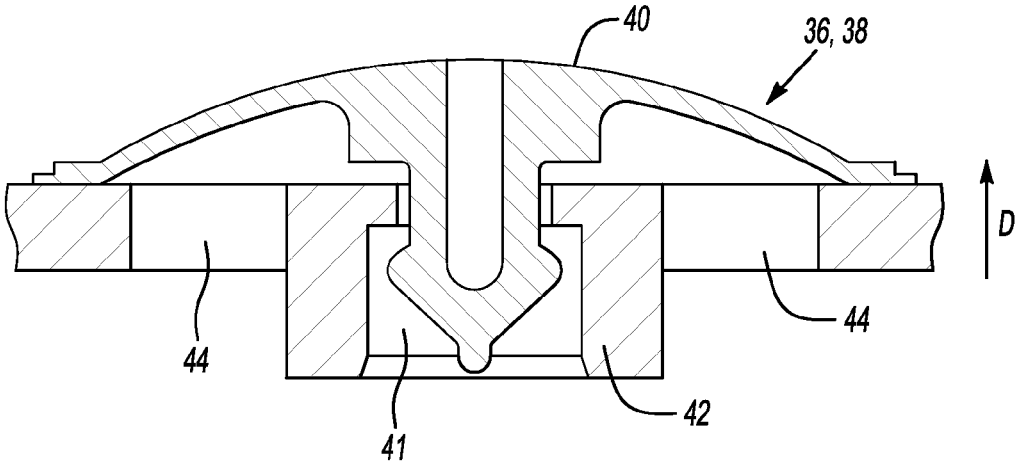
FIG. 3 is a side view of a check valve in accordance with an embodiment.

With reference to FIG. 3, each one-way check valve 36, 38 has a valve member 40 mounted in a free-floating manner to an opening 41 housing 42. In the embodiment, two openings 44 are provided in the housing 42 under the valve member 40. It can be appreciated that openings 44 need not be provided if opening 41 is sufficient to provide proper flow through the valve. The valve member 40 is movable due to pressure differences thereon. The valve member 40 is shown in a closed position in FIG. 3, sealed against the housing 42 and preventing air from flowing past the openings 41 and 44. Vacuum pressure, as mentioned above can pull the valve member 40 open (in the direction of arrow D), permitting air flow through the openings 41, 44.

It can be seen that the integrated canister purge valve 10 provides inline connections in a compact device. Since the venturi tube and check valves are integrated in the purge valve, fewer plumbing connections are required, which also simplifies assembly.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An integrated canister purge valve for a turbocharged vehicle engine, the valve comprising:

a valve member having a housing and being constructed and arranged to control vapor purge flow from a fuel tank and canister structure to an air intake manifold, a body coupled to the housing, the body defining an interior space, structure separating the interior space into a first chamber and a second chamber isolated from the first chamber, the first chamber having an inlet port and an outlet port, a vacuum generator in the first chamber and in fluid communication with the inlet and outlet ports, the vacuum generator being constructed and arranged to receive air from a turbocharger outlet, via the inlet port, to create a first vacuum when the air passes through the vacuum generator, and to direct air to an inlet of the turbocharger, via the outlet port, to define a scavenging air flow loop, a first check valve in the first chamber between the vacuum generator and the valve member, and a second check valve in the second chamber between the valve member and an manifold outlet port, the manifold outlet port being constructed and arranged to be coupled to an intake manifold, the first and second check valves being constructed and arranged such that 1) when the turbocharger is operating and the intake manifold is under positive pressure, the second check valve closes, while the first check valve opens upon the vacuum generator generating the first vacuum, to permit the purge flow to be drawn into the scavenging air flow loop and 2) in a naturally aspirated condition, manifold vacuum closes the first check valve and opens the second check valve to divert all of the purge flow through the manifold outlet port and to the intake manifold.

2. The valve of claim 1, wherein the vacuum generator is a venturi tube.

3. The valve of claim 1, in combination with the fuel tank and canister structure, the turbocharger, and the intake manifold.

4. The valve of claim 1, wherein the structure separating the interior space includes a wall and a cap member.

5. The valve of claim 1, wherein each of the check valves is a one way valve having an elastomer valve member constructed and arranged to move between open and closed positions based on pressure differences thereon.

6. The valve of claim 1, wherein the housing and the body are coupled together in a removable manner.

7. A method of controlling vapor purge flow in turbocharged vehicle, the method comprising:

providing a canister purge valve having a valve member constructed and arranged to control vapor purge flow from a fuel tank and canister structure to an air intake manifold, the purge valve having an integral vacuum generator and first and second check valves that are integral with the canister purge valve, the first check valve being disposed between the vacuum generator and the valve member, the second check valve being disposed between the valve member and a manifold outlet port, the manifold outlet port being coupled to the intake manifold, defining a scavenging air flow loop from a turbocharger outlet through the vacuum generator and to an inlet of the turbocharger, with the vacuum generator generating a first vacuum due to the air flow there-trough, when the turbocharger is operating and the intake manifold is under positive pressure, ensuring that the second check valve closes, while the first check valve opens upon the vacuum generator generating the first vacuum, to permit vapor purge flow to be drawn through the valve member into the scavenging air flow loop, and during a naturally aspirated condition, ensuring that vacuum created by the intake manifold closes the first check valve and opens the second check valve to divert all of the purge flow through the manifold outlet port and to the intake manifold, wherein the step of providing the canister purge valve includes providing the canister purge valve with a body, the body being separated into two chambers, the first check valve and vacuum generator being in the first chamber and the second check valve being in the second chamber.

8. The method of claim 7, wherein the vacuum generator is a venturi tube.

9. The method of claim 7, wherein the step of providing the canister purge valve includes coupling the body to a housing of the valve member in a removable manner.

10. The method of claim 7, wherein each of the check valves is a one-way valve having an elastomer valve member constructed and arranged to move between open and closed positions based on pressure differences thereon.

* * * * *